United States Patent [19]

Wiedemann et al.

[11] Patent Number: 4,714,666

[45] Date of Patent: Dec. 22, 1987

[54] PERYLENE TETRACARBOXYLIC ACID IMIDE PIGMENTS IN AN ELECTROPHOTOGRAPHIC RECORDING MATERIAL

[75] Inventors: Wolfgang Wiedemann, Geisenheim-Johannisberg; Ernst Spietschka, Idstein; Helmut Troester, Koenigstein, all of Fed. Rep. of Germany

[73] Assignee: Hoechst Aktiengesellschaft, Fed. Rep. of Germany

[21] Appl. No.: 888,496

[22] Filed: Jul. 23, 1986

[30] Foreign Application Priority Data

Jul. 23, 1985 [DE] Fed. Rep. of Germany ..... 3526249

[51] Int. Cl.[4] ..... G03G 5/06

[52] U.S. Cl. ..... 430/59; 430/75; 430/76

[58] Field of Search ..... 430/58, 59, 64, 65, 430/75, 76

[56] References Cited

U.S. PATENT DOCUMENTS

| | | | |
|---|---|---|---|
| 3,898,084 | 8/1975 | Champ et al. | 430/76 |
| 3,904,407 | 9/1975 | Regensburger et al. . | |
| 4,438,187 | 3/1984 | Fushida et al. . | |
| 4,447,514 | 5/1984 | Nakazawa et al. . | |
| 4,514,482 | 4/1985 | Loutfy et al. . | |

FOREIGN PATENT DOCUMENTS

| | | |
|---|---|---|
| 2237539 | 2/1974 | Fed. Rep. of Germany . |
| 2755851 | 6/1979 | Fed. Rep. of Germany . |

OTHER PUBLICATIONS

Nagao, Ishikawa, Tanabe, Misono, "Synthesis of Unsymmetrical Perylenebis (Dicarboximide) Derivatives", *Chemistry Letters*, No. 2 (Feb. 1979), at 151–154.

*Primary Examiner*—John L. Goodrow

*Attorney, Agent, or Firm*—Schwartz, Jeffery, Schwaab, Mack, Blumenthal & Evans

[57] ABSTRACT

An electrophotographic recording material comprises an electrically conductive base material, an optional insulating intermediate layer and a photoconductive layer comprising at least one layer containing an asymmetrically substituted perylene-3,4,9,10-tetracarboxylic acid imide as charge carrier producing compound, a photoconductor as charge transport compound, binder and customary additives. The asymmetrically substituted perylene-3,4,9,10-tetracarboxylic acid imide can, for example, be represented by the formula (I)

where R denotes hydrogen, alkyl, hydroxyalky, alkoxyalkyl, aryl or aralkyl and A denotes phenylene, naphthylene or a more highly fused aromatic carbocylic or heterocyclic radical which can each be substituted by halogen, alkyl, cyano or nitro groups. This material is suitable in double-layer arrangement for highly light sensitive systems, and in a single layer for preparing printing forms or printed circuits.

16 Claims, 7 Drawing Figures

1/E0,5
cm2/µJ
2,0
1,0
0,5
0,1
0,01
2
1
λ/nm
400
500
600
700

PERYLENE TETRACARBOXYLIC ACID IMIDE PIGMENTS IN AN ELECTROPHOTOGRAPHIC RECORDING MATERIAL

BACKGROUND OF THE INVENTION

The present invention relates to electrophotographic recording material comprising an electrically conductive base material, an optional insulating intermediate layer, and a photoconductive layer comprising at least one layer containing a perylene-3,4,9,10-tetracarboxylic acid imide charge carrier-producing compound, and a photoconductor as a charge transport compound, and a binder. The present invention further relates to recording material comprising an electrically conductive base material, an optional insulating intermediate layer, a dye layer containing a perylene-3,4,9,10-tetracarboxylic acid imide derivative as charge carrier-producing compound, and a layer containing an organic photoconductor as a charge transport compound.

The recording material according to the present invention can be used to advantage for an electrophotographically preparable lithographic printing form or printed circuit comprising a correspondingly suitable electrically conductive base material and a photoconductive layer including alkali-soluble binders.

The use of perylene-3,4,9,10-tetracarboxylic acid diimide derivatives as charge carrier producing pigment compounds in organic photoconductor layers is known (see, e.g., U.S. Pat. No. 3,904,407; German Offenlegungsschriften No. 2,237,539, corresponding to U.S. Pat. No. 3,871,882, and No. 2,314,051, corresponding to U.S. Pat. No. 3,972,717; and European Pat. No. 0 061 089). The known perylene-3,4,9,10-tetracarboxylic acid derivatives, as red-colored dyes, possess photosensitivities that extend, for example, into the region from 620 to 650 nm.

SUMMARY OF THE INVENTION

It is therefore an object of the present invention to provide perylene-3,4,9,10-tetracarboxylic acid imide derivatives having good photosensitivity up to 700 nm.

It is also an object of the present invention to provide an electrophotographic recording material that can be exposed using He/Ne laser and LED light sources, as well as other sources emitting in the spectral region of almost 700 nm.

In accomplishing the foregoing objects, there has been provided, in accordance with one aspect of the present invention, an electrophotographic recording material comprising an electrically conductive base material and a photoconductive layer provided on the base material, the photoconductive layer comprising at least one layer containing an asymmetrically substituted perylene-3,4,9,10-tetracarboxylic acid imide as charge carrier-producing compound, a photoconductor as charge transport compound, and a binder.

There has also been provided, in accordance with another aspect of the present invention, an electrophotographic recording material comprising an electrically conductive base material, a dye layer containing an asymmetrically substituted perylene-3,4,9,10-tetracarboxylic acid imide as charge carrier producing compound, and a layer containing organic photoconductor as charge transport compound.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
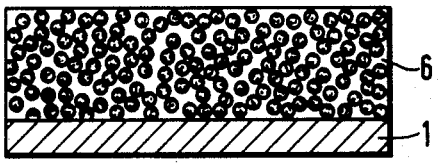
FIGS. 1 through 5 are schematic drawings providing a cross-sectional perspective of different recording material within the present invention.
Figure 2:
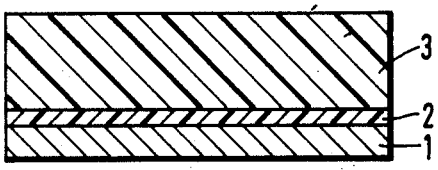
Figure 3:
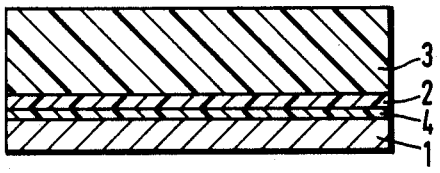
Figure 4:
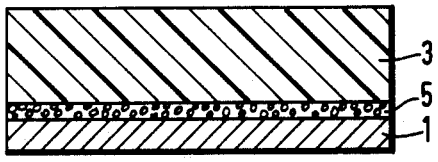

A perylene-3,4,9,10-tetracarboxylic acid imide of the present invention preferably has one of the following structures:

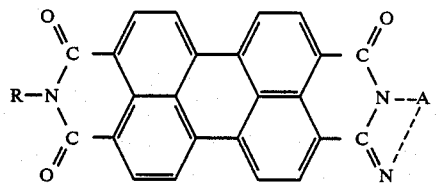

(I)

where

R denotes hydrogen, alkyl, hydroxyalkyl, alkoxyalkyl, aryl or aralkyl and

A denotes a radical selected from phenylene, naphthylene and a more highly fused aromatic carbocyclic or heterocyclic radical, which radical can be unsubstituted or substituted by halogen, alkyl-, cyano- or nitro-groups;

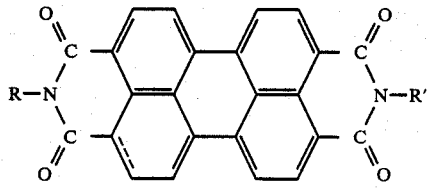

(II)

where R and R′ are different from each other and denote hydrogen or a group selected from alkyl, hydroxyalkyl, alkoxyalkyl, cycloalkyl, aryl, aralkyl and heteroaryl, which group can be unsubstituted or substituted by halogen, alkyl-, cyano- or nitro-groups; and

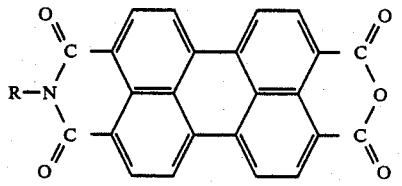

(III)

where R denotes hydrogen or a group selected from alkyl, hydroxylalkyl, alkoxyalkyl, aryl, aralkyl and heteroaryl, which group can be unsubstituted or substituted by halogen, alkyl-, cyano- or nitro-groups.

It is particularly preferred in compounds represented by formula (I) that

R denotes lower alkyl or benzyl,

A denotes phenylene;

in compounds represented by formula (II) that

R denotes hydrogen, lower alkyl or benzyl and

R' denotes lower alkoxylalkyl, lower alkyl substituted phenyl, benzyl or pyrenyl; and in compounds represented by formula (III) that R denotes lower alkyl, hydroxyl lower alkyl, lower alkoxylalkyl, benzyl or phenylethyl.

Among the suitable carbocylic and heterocyclic radicals for the present invention are 1,8-napthylene and pyridyl radicals. The cycloalkyl substituent employed in the present invention can be, for example, cyclohexyl.

It has been found, surprisingly, that the asymmetrical perylene-3,4,9,10-tetracarboxylic acid imides of the present invention, when used as charge carrier-producing pigments together with many organic photoconductors that function as charge transport compounds and, preferably with binders, provide good photosensitive recording materials, not only in double- but also in monolayer arrangement with pigment dispersely divided therein. Compared with the known perylimide dyes, the asymmetrical pigments according to the present invention have high photosensitivities extending into the region of almost 700 nm. This also permits their use in electrophotographic recording materials that are exposed to He/Ne laser and LED light sources.

But a particularly advantageous feature of the present invention is the wide variety of charge transport compounds and binders with which the above-described asymmetrical pigments can be combined to give highly sensitive photoconductor layers, an important factor in developing industrially utilizable organic photoconductor layers.

Methods for the preparation of perylene-3,4,9,10-tetracarboxylic acid imides within the invention are known. For example, methods for synthesizing perylene-3,4,9,10-tetracarboxylic monoanhydride monoimides which are required as starting materials in accordance with the present invention are described in German Offenlegungsschriften No. 3,008,420, corresponding to U.S. Pat. No. 4,501,906, and No. 3,017,185. More specifically, the cited documents disclose the preparation of perylene-3,4,9,10-tetracarboxylic monoanhydride monoalkali metal salts (a) and those of the perylene-3,4,9,10-tetracarboxylic monoanhydride monoimides (b)

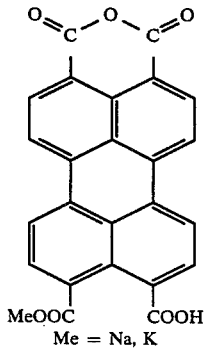

(a)

-continued

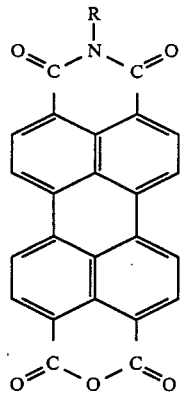

(b)

where, in the (b) compounds, substituent R is preferably hydrogen, alkyl (such as methyl to butyl), hydroxyalkyl (such as 2-hydroxyethyl), alkoxyalkyl (such as 3-methoxypropyl), and aralkyl (such as benzyl). The derivatives of the perylene-3,4,9,10-tetracarboxylic monoanhydride monoimide (b) can also be used successfully as charge carrier-producing compounds. Owing to their being readily soluble in alkali, they are utilizable, as is preferred, in alkali-soluble lithographic printing forms.

Starting from a compound of the formula (b), condensation with diamines (R(—NH2)2) or primary amines (R-NH2) gives the perylimidebenzimidazole(I) or peryldiimide(II) pigments used in the present invention.

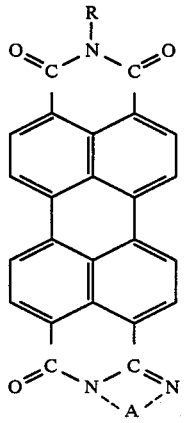

(I)

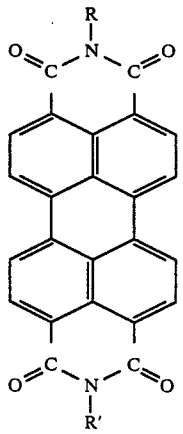

(II)

For instance, a compound of type (I) with R=CH3 and

A = 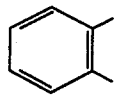

is described in *Chemistry Letters* (Japan) 1979: 151–154. The same publication also presents a type (II) pigment with R=H and R'=3,5-xylidine. These compounds, depending on the substituents, are red - dark red - dark violet colored pigments.

The configurations of electrophotographic recording material within the present invention are shown schematically in FIGS. 1 to 5. In each case, element 1 is the electrically conductive base material, element 2 the charge carrier-producing dye layer, and element 3 the charge transporting layer. Element 4 is an insulating intermediate layer, while element 5 includes those layers comprising a charge carrier-producing dye in dispersion. Element 6 is a photocon-ductive monolayer containing photoconductor, perylene-3,4,9,10-tetracarboxylic acid imide and a binder.

The electrically conductive base material used in the present invention is preferably aluminum foil or, optionally transparent polyester film which is vapor-deposited or laminated with aluminum. But it is also possible to use any other base material which has been made sufficiently conductive, for example, by means of carbon black. The photoconductor layer can also be arranged on a drum, on flexible continuous tapes (for example, made of nickel or steel) or on plates.

The base materials used for the electrophotographic preparation of printing forms according to the present invention can be any of the materials known for this purpose, such as aluminum, zinc, magnesium and copper plates and multimetal plates. Surface-treated aluminum foils have been found to be particularly suitable. The surface treatment comprises a mechanical or electrochemical roughening and, where appropriate, a subsequent anodizing and treatment with polyvinylphosphonic acid as described in German Offenlegungsschrift No. 1,621,478, corresponding to U.S. Pat. No. 4,153,461.

The insertion of an insulating intermediate layer, including, where appropriate, a thermally, anodically or chemically produced aluminum oxide intermediate layer (FIG. 3, element 4), has the purpose of reducing the injection of charge carrier from the metal base material into the photoconductor layer in the dark. But the intermediate layer should not prevent charge flux during exposure. The intermediate layer acts as a barrier layer; it may also improve adhesion between the base material surface and the dye layer or photoconductor layer and, to prepare printing forms, which should be soluble in aqueous or alcholic/alkaline solutions.

The intermediate layer can incorporate different natural or synthetic resin binders, but preference is given to using those materials that firmly adhere to a metal, specifically an aluminum, surface, and are swelled only a little during the subsequent application of further layers. They include polyamide resins, polyvinyl alcohols, polyvinyl-phosphonic acid, polyurethanes and polyester resins, and specifically alkali-soluble binders, such as styrene/maleic anhydride copolymers.

The thickness of organic intermediate layers can be up to 5 μm, while that of an aluminum oxide intermediate layer is in general within the range from 0.01 to 1 μm.

A dye layer of the invention (elements 2 and 5 in FIGS. 2 to 5, respectively) has the function of a charge carrier producing layer. The dye used in such a layer determines the spectral photosensitivity of the photoconductive system through its absorption behavior.

The application of a homogeneous, densely packed dye layer is preferably obtained by vapor deposition of the pigment onto the base material in vacuo. Depending on the vacuum setting, the dye can be vapor deposited without decomposition under the conditions of $1.33\times10^{-6}$ to $10^{-8}$ bar and 240° to 290° C. heating temperature. In the vapor-deposition process, the temperature of the base material is below 50° C.

As a result, layers with densely packed dye molecules are obtained. This has the advantage, over all other possibilities of producing very thin homogeneous dye layers, of making possible an optimal charge production rate in the dye layer. The extremely finely disperse division of the pigment permits a high concentration of excited dye molecules which inject charges into the transport layer. Moreover, the charge transport through the dye layer is hindered little, if at all, by binder.

An advantageous layer thickness range of the vapor deposited dye is between 0.005 and 3 μm. Particular preference is given to a thickness range between 0.05 and 1.5 μm, since with this range the adhesion and homogeneity of the vapor deposited pigment are particularly advantageous.

Apart from vapor depositing the dye, uniform dye thickness can also be obtained by other coating techniques. These include application by mechanically rubbing the extremely finely powdered dye material into the electrically conductive base material, by electrolytic or electrochemical processes or by electrostatic spray technology.

In combination with an intermediate layer, or as a replacement for such a layer, it is also possible to obtain homogeneous, high-covering dye layers having thicknesses on the order of 0.05 to 3 μm by grinding the dye with binders, particularly with cellulose nitrates and/or crosslinking binder systems, for example, polyisocyanate-crosslinkable acrylic resins and reactive resins, such as epoxides and DD-Lacquers. These dye dispersions are subsequently applied as coatings, as represented by element 5 in FIGS. 4 and 5. It is also possible to use binders such as polystyrene, styrene/maleic anhydride copolymers, polymethacrylates, polyvinyl acetates, polyurethanes, polyvinyl butyrals, polycarbonates and polyesters, and mixtures thereof.

The dye/binder ratio can vary within wide limits, although preference is given to pigment precoatings having a pigment content of above 50% and correspondingly high optical density.

Another embodiment of the present invention involves preparing a photoconductor monolayer in accordance with FIG. 1, in which the charge production centers (pigments) are finely dispersed in the transport layer medium. This arrangement, compared with that of a double layer, has the advantage of simpler method of manufacture, and is particularly suitable for preparing lithographic printing forms. The single photoconductive layer has a pigment content of preferably up to about 30%, and a thickness preferably on the order of 2 to 10 μm.

Figure 5:
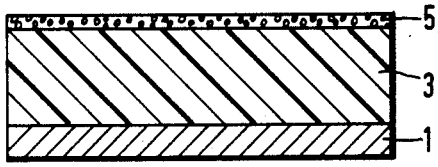

The inverse arrangement of the charge carrier-producing layer 5 in FIG. 5 on the charge transporting layer 3 permits, with the use of a p-transport compound, photoconductor double layers, which on positive charge possess a high photosensitivity.

The material which serves for charge transport in the present invention can in particular be any organic compound that has an extended $\pi$-electron system. This includes monomeric as well as polymeric aromatic or heterocyclic compounds.

The monomers used are preferably those that have at least one tertiary amino group and/or one dialkylamino group. Of proven suitability are particularly heterocyclic compounds, such as oxadiazole derivatives, which are mentioned in German Pat. No. 1,058,836 (corresponding to U.S. Pat. No. 3,189,447). They include, in particular, 2,5-bis-(p-diethylaminophenyl)-1,3,4-oxadiazole; it is also advantageous to use asymmetrical oxadiazoles such as 5-[3-(9-ethyl)-carbozolyl]-1,3,4-oxadiazole derivatives (U.S. Pat. No. 4,192,677), for example, 2-(4-dialkylaminophenyl)-5-[3-(9-ethyl)-carbazolyl]-1,3,4-oxadiazole. Additional suitable monomeric compounds are arylamine derivatives (triphenylamine) and triarylmethane derivatives (German Pat. No. 1,237,900), for example, bis(4-diethylamino-2-methylphenyl)phenylmethane; and more highly fused aromatic compounds, such as pyrene and benzofused heterocycles (for example, benzoxazole derivatives). Also suitable are pyrazolines, for example, 1,3,5-triphenylpyrazolines, and imidazole derivatives (German Pat. No. 1,060,714 and No. 1,106,599, respectively, corresponding to U.S. Pat. No. 3,180,729 and British Pat. No. 938,434). Also to be included are triazole, thiadiazole and, in particular, oxazole derivatives, for example, 2-phenyl-4-(2'-chlorophenyl)-5(4'-diethylamino-phenyl)-oxazole, as disclosed in German Pat. Nos. 1,060,260, 1,299,296 and 1,120,875 (corresponding to U.S. Pat. No. 3,112,197, British Pat. No. 1,016,520, and U.S. Pat. No. 3,257,203, respectively).

Also particularly useful in this context are 4-chloro-2(4-dialkylaminophenyl)-5-aryloxazole derivatives represented by the formula

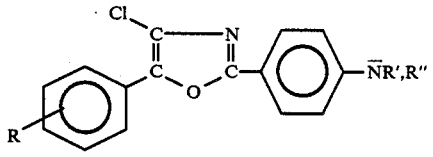

where R can be H, halogen, alkyl and alkoxy, and R', R'' can be alkyl groups. The preparation of these compounds is disclosed in German Offenlegungsschrift No. 2,844,394.

The class of charge transport compounds suitable for the present invention further includes hydrazone derivatives represented by the formula $$[(\text{alkyl})_2\text{N}-]\text{Ar}-\text{CH}=\text{N}-\underset{\underset{\text{R}}{|}}{\text{N}}-\text{Ar}$$

where R denotes alkyl, aryl or benzyl.

Representative compounds of this type, e.g., $$\text{3-(9-ethyl)carbazolyl-CH}=\text{N}-\underset{\underset{\text{R}}{|}}{\text{N}}-\text{Ar}$$

are described in U.S. Pat. No. 4,150,987 and in German Offenlegungsschriften Nos. 2,941,509, 2,919,791 and 2,939,483 (corresponding to U.S. Pat. Nos. 4,338,388, 4,278,747 and British Pat. No. 2,034,493, respectively).

Among the suitable polymers for the present invention are formaldehyde condensation products with various aromatics, such as condensates from formal-dehyde and 3-bromopyrene (German Offenlegungsschrift No. 2,137,288, corresponding to U.S. Pat. No. 3,842,038). Polyvinylcarbazole and copolymers having a vinylcarbazole content of at least 50% provide high photosensitivity when employed as transport polymers, for example, in double layer arrangements (FIGS. 2 to 4), in the present invention.

Absent the dye layer, the charge transport layer 3 has practically no photosensitivity in the visible region (420 to 750 nm), and preferably comprises a mixture of an electron donor compound (organic photoconductor) with a binder, if the chargeup is to be negative. Although the charge transport layer is preferably transparent, this is not necessary when a transparent, conductive base material is used. Layer 3 has a high electric resistance of greater than 1012 Ω. In the dark it prevents scattering of the electro-static charge; on exposure the layer 3 transports the charges produced in the dye layer.

In addition to the above-described charge producing and transport materials, the added binder affects not only the mechanical behavior, such as abrasion, flexibility, film formation and adhesion, but also, to a certain extent, the electrophotographic behavior (photosensitivity, residual charge, cyclic behavior, etc.) of electrophotographic recording material of the present invention. The binders used can be polyester resins, polyvinyl chloride/polyvinyl acetate copolymers, alkyd resins, polyvinyl acetates, polycarbonates, silicone resins, polyurethanes, epoxy resins, poly(meth)acrylates and copolymers, polyvinyl acetals, polystyrenes and styrene copolymers, and cellulose derivatives, such as cellulose acetobutyrates. Successful use is also made of thermally crosslinking binder systems, such as reactive resins, which are composed of an equivalent mixture of hydroxyl-containing polyesters or polyethers and polyfunctional isocyanates, polyisocyanate-crosslinkable acrylate resins, melamine resins, unsaturated polyester resins, etc.

Owing to their high photosensitivity, flash light sensitivity and high flexibility, the use of highly viscous cellulose nitrates is particularly preferred.

The choice of binders is determined not only by a consideration of film-forming, electrical, and (in the case of use for printing forms or printed circuits) adhesion-to-base properties but also by solubility properties in particular. For practical purposes, particularly suitable binders are those that are soluble in aqueous or alcoholic solvent systems, optionally in the presence of added acid or alkali. Suitable binders are accordingly high molecular weight substances which carry alkali-solubilizing groups. Such groups include, for example, acid anhydride, carboxyl, phenol, sulfonic acid, sulfonamide or sulfonimide groups.

Copolymers having anhydride groups can be used particularly successfully. Very particularly suitable copolymers are comprised of ethylene or styrene and maleic anhydride or maleic acid half-esters. Phenolic resins have also proved suitable.

The alkali-soluble binders used can also be copolymers of styrene, methacrylic acid and methacrylic acid esters (German Offenlegungsschrift No. 2,755,851). A copolymer of 1 to 35% styrene, 10 to 40% methacrylic acid and 35 to 83% n-hexyl methacrylate can be employed to particular advantage. A terpolymer of 10% styrene, 30% methacrylic acid and 60% n-hexyl methacrylate is very highly suitable. It is also possible to use polyvinyl acetates (PVAc), especially copolymers of PVAc and crotonic acid.

The binders used can be used alone or in combination.

The mixing ratio of the charge transporting compound to the binder can vary. But the requirement for maximum photosensitivity, i.e., a very high proportion of charge transport compound, and for avoiding crystallization, as well as increased flexibility, i.e., a very high proportion of binders, sets certain relative limits. In general, a mixing ratio of about 1:1 parts by weight has been found to be preferable, but ratios between 4:1 to 1:4 are also suitable.

In the case of using polymeric charge transport compounds, such as bromopyrene resin, polyvinyl-carbazole, binder contents around or below 30% are suitable.

The respective demands imposed by a copying machine on the electrophotographic and mechanical properties of recording material can be generally met, in accordance with the present invention, by varying the layers, for example, in terms of binder viscosity and the proportion of the charge transport compound.

In addition to the transparency of the charge transporting layer, its layer thickness also substantially affects optimal photosensitivity: layer thicknesses between about 2 and 25 μm are generally used. A thickness range from 3 to 15 μm has been found to be particularly advantageous. If permitted by the mechanical requirements and the electrophotographic parameters (chargeup and development units) of a copying machine, however, the indicated limits can be extended upward or downward from case to case.

Customary additives for use in the present invention include flow control agents such as silicon oils; wetting agents, in particular nonionic substances; and plasticizers of different compositions, such as those based on chlorinated hydrocarbons and those based on phthalic acid esters. Where appropriate, conventional sensitizers and/or acceptors can be added to the charge transporting layer, but only to the extent that the optical transparency of the layer is not significantly impaired.

The present invention is illustrated in more detail below by reference to the following, nonlimiting examples.

EXAMPLE 1

Pigments represented by formula (I), where A is unsubstituted phenylene and

Compound 1: R=—$CH_3$ or

Compound 2: R=

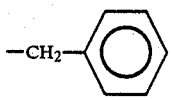

respectively, were vapor deposited onto an aluminum vapor-deposited polyester film under a vacuum ranging from $1.33\times10^{-7}$ to $10^{-8}$ bar over a period of 2 to 3 minutes at 250° to 260° C. This procedure yielded homogeneous pigment layers having layer weights of between 100 to 300 mg/m$^2$. With the vapor deposition, the base material was completely covered.

A solution containing equal parts by weight of 2,5-bis(4-diethylaminophenyl)-1,3,4-oxadiazole ("To 1920"; melting point of 149° to 150° C.) and a polyurethane resin (Desmolac ® 2100, Bayer AG) in tetrahydrofuran (THF) was coated onto these vapor-deposited layers. The layer was then dried in the course of 5 minutes at about 100° C. in a through-circulation cabinet. The layer thickness afterwards was 7 to 8 μm, and the layer adhered firmly to the base.

Measurement of the photosensitivity of the resulting composites was carried out as follows: To determine the light decay curves, the test sample was moved on a turntable through a chargeup apparatus to an exposure station, where it was continuously exposed with an XBO 150 xenon lamp or halogen-W lamp (150 W). A heat absorption glass and a neutral filter had been placed in front of the lamp. The light intensity in the plane of measurement was in the range from 30 to 50 μw/cm$^2$ or 5 to 10 μW/cm$^2$, respectively, and was measured with an optometer immediately after or during the determination of the light decay curve. The altitude of the charge and the photoinduced decay curve were recorded oscillographically, via an electrometer, by means of a transparent sensor. The photoconductor layers were characterized by their altitude of charge ($U_o$) and the time ($T_{\frac{1}{2}}$) when half the charge ($U_{o/2}$) was reached. The product of $T_{\frac{1}{2}}$ [s] and the measured light intensity I [μW/cm$^2$] was the half-value energy $E_{\frac{1}{2}}$ [μJ(cm$^2$].

By this method of characterization, the photosensitivity of the double layer was determined.

| Photoconductor layer with pigment I | (−)$U_o$/V | $U_R$/V (0.1 s) | $E_{\frac{1}{2}}$ [μJ/cm$^2$] |
|---|---|---|---|
| Compound 1 | 500 | 230 | 1.8 |
| Compound 2 | 410 | 160 | 1.4 |

The residual charge ($U_R$) after 0.1 sec., determined from the above brightness discharge curves, was a further measure of the discharge of the photo-conductor layer.

EXAMPLE 2

Sets of pigment layers comprising the formula (I) asymmetrical perylimide dyes of Example 1 were prepared as described in Example 1. These vapordeposited layers were then coated with a solution containing 65 parts by weight of "To 1920" and 35 parts by weight of cellulose nitrate of standard type 4E (DIN 53179) in THF. After drying, the layer thicknesses were within the range of 7 to 8 and 12 to 13 μm, respectively.

The photosensitivity of these photoconductor double layers was determined as in Example 1:

| Photoconductor layer with pigment I | Layer thickness μm | (−)$U_o$/V | $U_R$/V (0.1 s) | $E_{\frac{1}{2}}$ [μJ/cm$^2$] |
|---|---|---|---|---|
| Compound 1 | 7-8 | 450 | 130 | 1.0 |
| | 12-13 | 470 | | 1.7 |

-continued

| Photoconductor layer with pigment I | Layer thickness μm | $(-)U_o/V$ | $U_R/V$ (0.1 s) | $E_{\frac{1}{2}}$ [μJ/cm²] |
|---|---|---|---|---|
| Compound 2 | 7–8 | 370 | 80 | 0.8 |
| | 12–13 | 460 | | 1.3 |

The spectral photosensitivity of these photoconductor double-layers was determined, with interposition of filters, by the method of Example 1. With a negative charge (500 to 550 V), the half-value time ($T_{\frac{1}{2}}$ in msec) was thus determined for the respective wavelength range by exposure. By plotting reciprocal half-value energy ($1/E_{\frac{1}{2}}cm^2/\mu J$) against wavelength λ (nm), the spectral photosensitivity curve of the photoconductor layer was obtained. The half-value energy $E_{\frac{1}{2}}/\mu J/cm^2$ denotes that light energy that must be irradiated in order to discharge the photoconductor layer to half the initial voltage $U_o$.

Figure 6:
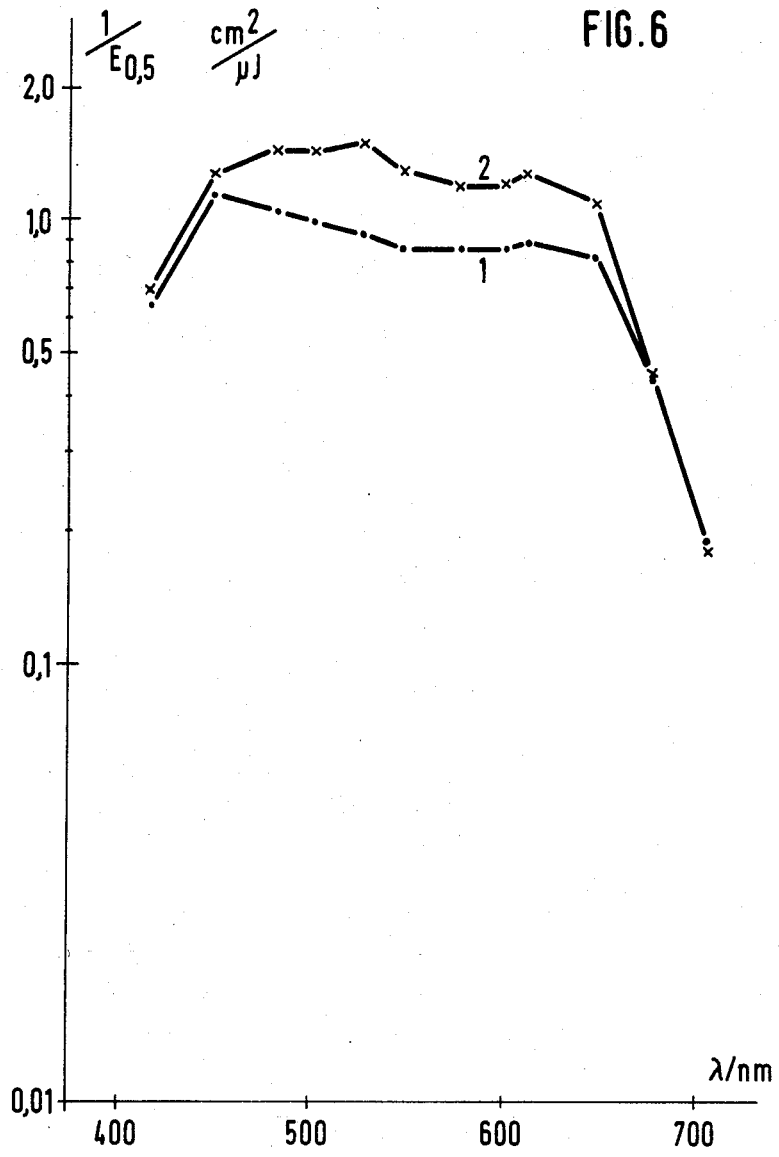
FIGS. 6 and 7 are graphs depicting the spectral photosensitivities of three different recording materials of the present invention.

FIG. 6 shows the spectral photosensitivities of photoconductor double layers, layer thicknesses of 12 to 13 μm, comprising pigment I, compounds 1 and 2.

EXAMPLE 3

A vapor-deposited layer comprising pigment I, compound 1 was coated with a solution containing equal parts by weight of 2-phenyl-4-(2'-chlorophenyl)-5(4'-diethylaminophenyl)-oxazole ("layer 3-1" in the following table) and a polyester resin (Dynapol ® L206) in THF. In another coating solution this oxazol derivative was replaced by 2-(4'-diethylaminophenyl)-4-chloro-5(4'-methoxyphenyl) oxazole ("layer 3-2"). The two double layers, with layer thicknesses of 7 to 8 μm, gave the following photosensitivities:

| Photoconductor double layer | $(-)U_o/V$ | $U_R/V$ (0.1 s) | $E_{\frac{1}{2}}$[μJ/cm²] |
|---|---|---|---|
| 3–1 | 450 | 270 | 3.3 |
| 3–2 | 630 | 300 | 1.9 |

EXAMPLE 4

The very good photosensitivity obtained by coating 50 parts by weight of "To 1920" with 50 parts by weight of various binders in 7 to 8 μm-thicknesses (solvent THF) on a vapor-deposited layer comprised of pigment I, compound 2, is indicated by the data in the following table:

| Binder | $(-)U_oV$ | $U_R/V$ (0.1 s) | $E_{\frac{1}{2}}$ [μJ/cm²] |
|---|---|---|---|
| Polycarbonate (Makrolon ® 2405) | 470 | 220 | 1.8 |
| Styrene/maleic anhydride copolymer (Lytron ® 820) | 430 | 190 | 1.5 |
| Polyester resin (Dynapol ® L206) | 420 | 170 | 1.6 |
| Polyvinyl chloride/ polyvinyl acetate copolymer (Hostaflex ® M131) | 500 | 180 | 1.2 |
| Cellulose acetobutyrate (EAB 381-20) | 500 | 250 | 1.95 |

EXAMPLE 5

A mixture containing 65 parts by weight of pigment I, compound 2, 25 parts by weight of cellulose nitrate of the standard type 4E (DIN 53179), and 10 parts by weight of epoxy resin (Epikote ® 1001) was thoroughly ball-milled together in THF for 2 to 3 hours. The finely dispersed solution was then homogeneously applied to a conductive base material to thicknesses of about 210 mg/m² and about 490 mg/m², respectively, and was dried.

To increase photosensitivity, a portion of the pigment precoated layer was polished with cotton. The pigment precoating (about 490 mg/m²), which was insoluble for the subsequent coating of the charge transport layer, was then coated (i) with a solution containing equal parts by weight of "To 1920" and a copolymer of styrene/butadiene (Pliolite ® S5B) and (ii) with a solution of 98 parts by weight of a polyvinylcarbazole (Luvican ® M170, BASF) and 2 parts by weight of polyester resin (Adhesive ® 49000) in THF. After drying, the double layer was 4 to 5 μm-thick; its photosensitivity was determined as described in Example 1:

| Charge transport layer with | $(-)U_o/V$ | $U_R/V$ (0.1 s) | $E_{\frac{1}{2}}$ [μJ/cm²] | Remarks |
|---|---|---|---|---|
| To 1920 | 520 | 370 | 4.0 | After polishing |
| | 350 | 190 | 2.3 | |
| Luvican ® | 630 | 570 | 8.8 | |
| M170 | 600 | 510 | 5.7 | |

EXAMPLE 6

A polyester film vapor-deposited with aluminum was vapor-deposited under vacuum with the pigments represented by formula (II), where Compound 3: R=—H and R'=

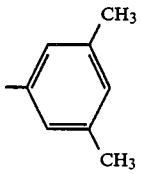

and

Compound 4: R=—$CH_3$ and R'=

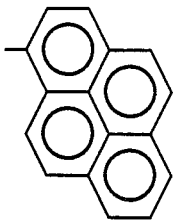

in a thickness of about 200 mg/m². The homogeneous pigment layers were then coated with a solution containing equal parts by weight of 2-(4-diethylaminophenyl)-4-chloro-5-(4-methoxyphenyl)oxazole and polycarbonate (Makrolon ® 2405) in a thickness of approximately 8 μm after drying.

The photosensitivities were measured as in EXAMPLE 1:

| Layer with pigment II | $(-)U_o/V$ | $E_{\frac{1}{2}}$ [$\mu J/cm^2$] |
|---|---|---|
| Compound 3 | 500 | 2.63 |
| Compound 4 | 470 | 2.73 |

EXAMPLE 7

A vapor-deposited pigment layer of about 135 $mg/m^2$ in thickness, comprising a pigment (compound 5) according to formula (II) where R=—H and R'=

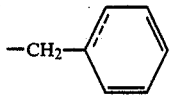

was prepared as described in Example 1 and was coated with a solution containing 98 parts by weight of polyvinylcarbazole (Luvican® M170) and 2 parts by weight of polyester resin (Adhesive® 49000) in THF. After drying, the double layer thickness was 7 μm. According to measurements taken as in Example 1, a half-value energy $E_{\frac{1}{2}}$ of 2.1 μj/cm2 was present in the case of a negative chargeup of 510 V.

EXAMPLE 8

Additional vapor deposited layers were prepared using the asymmetrical perylimide pigments represented by formula (II) when Compound 6: R=—$CH_3$ and R'=

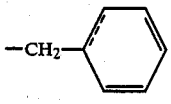

and

Compound 7:

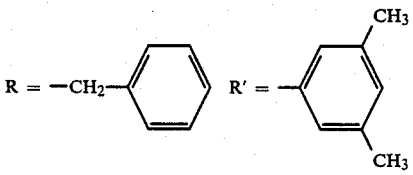

The thickness of these homogeneous dye layers was 185 and 150 $mg/m^2$, respectively. A solution containing equal parts by weight of "To 1920" and a copolymer of styrene and maleic anhydride (Scripset® 540) was applied in a thickness of about 8 μm. Measurements of photosensitivity gave the following values:

| Double Layer with pigment II | $(-)U_o/V$ | $E_{\frac{1}{2}}$ [$\mu J/cm^2$] |
|---|---|---|
| Compound 6 | 590 | 3.2 |
| Compound 7 | 630 | 3.2 |

EXAMPLE 9

To a solution containing 45 parts of "To 1920" and 50 parts of copolymer of styrene and maleic anhydride (Scripset® 550) were added 5 parts of pigment I, compound 2. The resulting dispersion was ball-milled for about 2 hours until very fine, and was subsequently coated onto wire-brushed aluminum foil (a) and anodized aluminum foil (b) in a thickness of 7 to 8 μm. Photosensitivity was measured as in Example 1, with a halogen-tungsten lamp and both positive and negative charging yielding the following data:

| Layers on base material | $(-)U_o/V$ | $E_{\frac{1}{2}}$[$\mu J/cm^2$] | $(+)U_o/V$ | $E_{\frac{1}{2}}$[$\mu J/cm^2$] |
|---|---|---|---|---|
| (a) | 390 | 5.0 | 320 | 6.0 |
| (b) | 430 | 5.0 | 395 | 8.2 |

EXAMPLE 10

A vapor deposited layer (pigment I, compound 1) according to Example 1 was coated in each case with a solution containing equal parts by weight of polycarbonate (Makrolon® 3200) and of the organic photoconductor compounds (a) 1,3,5 triphenylpyrazoline, (b) bis(4-diethylamino-2-methylphenyl)phenylmethane and (c) 9-ethylcarbazole-3-aldehyde-1,1-diphenylhydrazone in 7 to 8 μm thickness (dry) for (a) and (b) and 9 to 10 μm for (c). The photosensitivity was measured with a halogentungsten lamp, as described in Example 1:

| Layer coated | $(-)U_o/V$ | $E_{\frac{1}{2}}$ [$\mu J/cm^2$] |
|---|---|---|
| (a) | 470 | 1,96 |
| (b) | 340 | 3,01 |
| (c) | 400 | 0,93 |

EXAMPLE 11

A dye (compound 8) of the formula III, where R is methyl, was prepared in accordance with German Offenlegungsschrift No. 3,017,185. The dye was then vapor-deposited, under a vacuum vapor in the range of $1.3\times10^{-7}$ to $10^{-8}$ bar over a period of 7 minutes at about 250° C., onto a polyester film coated with aluminum by vapor-deposition. The result was a homogeneous, red dye layer having a layer weight of 135 $mg/m^2$.

This layer was tin coated with a solution containing 65 parts by weight of "To 1920" and 35 parts by weight of cellulose nitrate of standard type 4E in THF. After drying, the thickness of the charge transport layer was about 10 μm.

Figure 7:
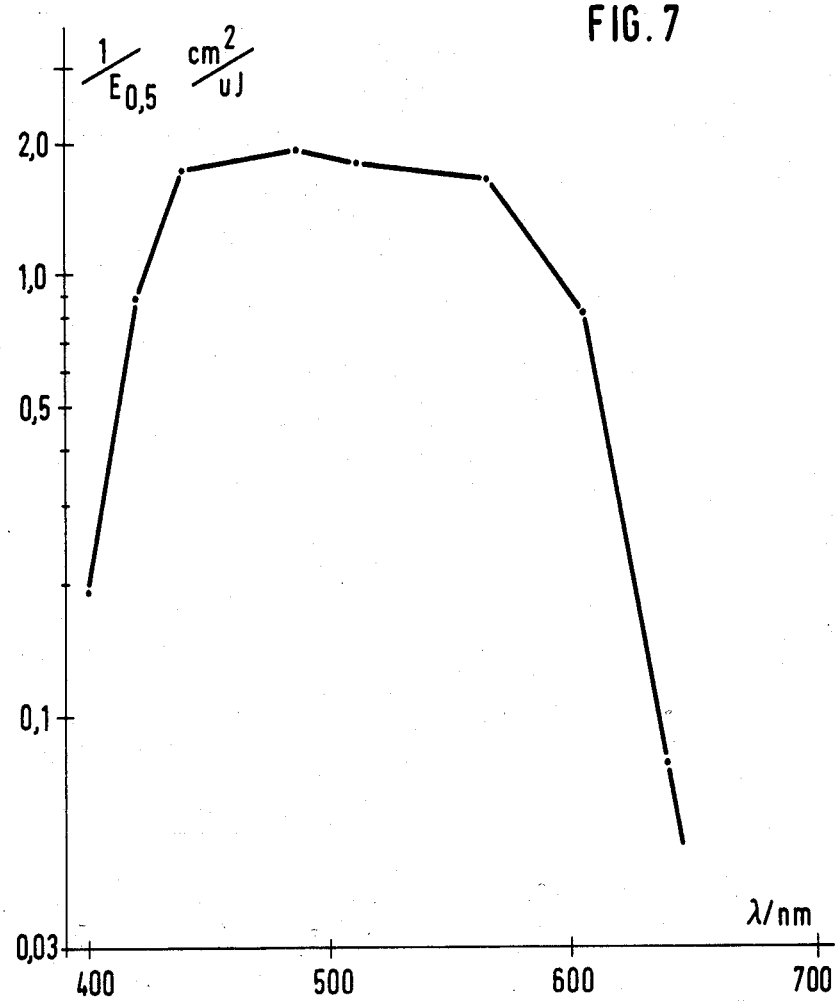

Photosensitivity was measured as described in Example 1 with a halogen-tungsten lamp (illumination intensity about 4.5μW/$cm^2$): Charge (−) 1320 V and $E_{\frac{1}{2}}$=0.92 μJ/cm². The spectral photosensitivity of this layer is evident from FIG. 7, and was determined as described in Example 2 with negative charge of 300 to 350 V.

EXAMPLE 12

Dye vapor deposited layers with thicknesses ranging from 135 to 140 $mg/m^2$ were prepared with compound 8, as described in Example 11, and a pigment of formula (II) where Compound 9: R=—$CH_3$ and R'=—$CH_2$—$CH_2$—$CH_2$—O—$CH_3$.

The layers were coated with a charge transport layer comprising equal parts by weight of "To 1920" and a copolymer of styrene and maleic anhydride (Scripset 550). The total layer thicknesses were about 10 μm. The photosensitivity was measured as in Example 1:

| Layers with pigment | $(-)U_o/V$ | $E_{\frac{1}{2}}$ [μJ/cm²] |
|---|---|---|
| Compound 8 | 320 | 2.04 |
| Compound 9 | 410 | 2.75 |

EXAMPLE 13

To a solution containing 45 parts of "To 1920" and 50 parts of copolymer of styrene and maleic anhydride (Scripset 550) were added 5 parts of a pigment (compound 10) represented by formula (III), where $R=-(CH_2)_3-O-(CH_2)_3-CH_3$.

The resulting mixture was finely dispersed in a ball mill during about 2 hours. This dispersion was then coated onto wire-brushed aluminum foil to approximately 10 μm thickness. The photosensitivity in the case of positive (+) and negative (−) charge gave the following values (halogen-tungsten lamp):

(+) charge:260 V $E_{\frac{1}{2}}=5.9$ μJ/cm²

(−) charge:510 V $E_{\frac{1}{2}}=7.9$ μJ/cm²

EXAMPLE 14

The vapor deposition layers comprising the perylenetetracarboxylic acid monoimides represented, respectively, by formula (III) where Compound 11: $R=-(CH_2)_3-CH_3$ and Compound 12: $R=-CH_2-CH_2-OH$ were prepared in 115 and 110 mg/m² thicknesses, as described in Example 1. These layers were coated with a solution containing 66.7 parts of "To 1920" and 33.3 parts of cellulose nitrate of standard type 4E (DIN 53179) in THF. After drying, the layer thickness was 10 to 11 μm.

The photosensitivity of the two double layers was determined as in Example 1 (halogen-tungsten lamp):

| Layers with pigment III | $(-)U_o/V$ | $E_{\frac{1}{2}}$ [μJ/cm²] |
|---|---|---|
| Compound 11 | 320 | 0.9 |
| Compound 12 | 290 | 2.1 |

EXAMPLE 15

Vapor deposition layers comprising the perylenetetracarboxylic acid monoimides represented by formula (III), where Compound 13: $R=-CH_2-C_6H_5$ and Compound 14: $R=-CH_2-CH_2-C_6H_5$ were applied to aluminum vapor-deposited polyester film in 120 and 105 mg/m² thickness. The conditions for vapor deposition were about 270° C. and 10 minutes at $1.33\times10^{-7}$ to $10^{-8}$ bar.

The homogeneous, deep red dye layers were coated with a solution of 50 parts of "To 1920," 25 parts of polyester resin (Dynapol L206) and 25 parts of polyvinyl chloride/polyvinyl acetate copolymer (Hostaflex ® M131) in 8 to 9 μm thickness. Photosensitivity measurements according to Example 1, made using a halogen-tungsten light, gave the following results:

| Layers with pigment III | $(-)U_o/V$ | $E_{\frac{1}{2}}$ [μJ/cm²] |
|---|---|---|
| Compound 13 | 390 | 3.7 |
| Compound 14 | 440 | 3.2 |

What is claimed is:

1. An electrophotographic recording material comprising an electrically conductive base material and a photoconductive layer provided on said base material, said photoconductive layer comprising at least one layer containing an asymmetrically substituted perylene-3,4,9,10-tetracarboxylic acid imide as charge carrier-producing compound, a photoconductor as charge transport compound, and a binder, wherein said acid imide is a charge carrier-producing compound represented by one of the following formulas:

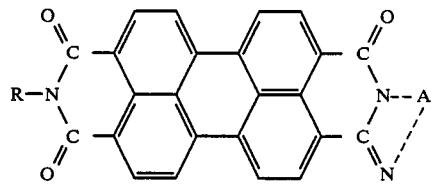

(I)

where

R denotes hydrogen, alkyl, hydroxyalkyl, alkoxyalkyl, aryl or aralkyl and

A denotes a radical selected from a phenylene, a napthylene and a more highly fused aromatic carbocyclic or heterocyclic radical, said radical being unsubstituted or substituted by a halogen, an alkyl group, a cyano group or a nitro group;

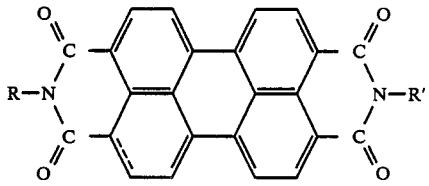

(II)

where

R and R' are different from each other and denote hydrogen or a group selected from alkyl, hydroxyalkyl, alkoxyalkyl, cycloalkyl, aryl, aralkyl and heteroaryl, said group being unsubstituted or substituted by a halogen, alkyl group, cyano group or nitro groups;

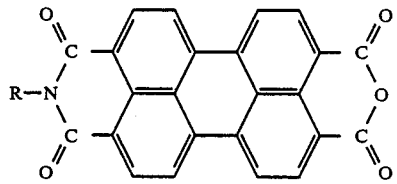

(III)

where

R denotes hydrogen or a group selected from alkyl, hydroxyalkyl, alkoxyalkyl, aryl and aralkyl, said group being unsubstituted or substituted by a halogen, an alkyl group, a cyano group or a nitro group.

2. The recording material as claimed in claim 1, wherein said perylene-3,4,9,10-tetracarboxylic acid imide is represented by formula (I)

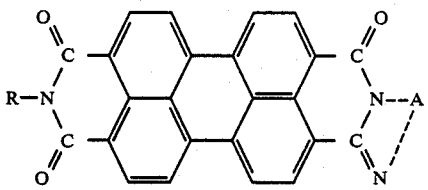

(I)

3. The recording material as claimed in claim 2, wherein R in formula (II) denotes lower alkyl or benzyl, and A denotes unsubstituted phenylene.

4. The recording material as claimed 1, wherein said perylene-3,4,9,10-tetracarboxylic acid imide is represented by formula (II)

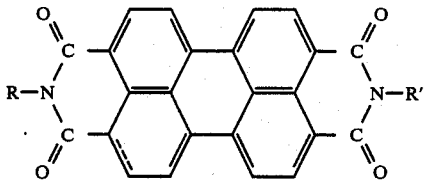

(II)

5. The recording material as claimed in claim 4, wherein, for formula (II), R denotes hydrogen, lower alkyl or benzyl and R' denotes lower alkoxyalkyl, lower alkyl-substituted phenyl, benzyl or pyrenyl.

6. The recording material as claimed in claim 1, wherein said perylene-3,4,9,10-tetracarboxylic acid imide is represented by formula (III)

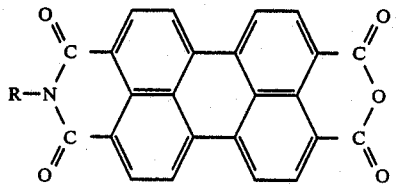

(III)

7. The recording material as claimed in claim 6, wherein R in formula (III) denotes lower alkyl, hydroxy lower alkyl, lower alkoxyalkyl, benzyl or phenylethyl.

8. The recording material as claimed in claim 1, wherein said binder is soluble in are aqueous alkali solution.

9. An electrophotographic recording material comprising an electrically conductive base material, a dye layer containing an asymmetrically substituted perylene-3,4,9,10-tetracarboxylic acid imide as carrier-producing a compound, and a layer containing an organic photoconductor as charge transport compound, wherein said acid imide is a charge carrier-producing compound represented by one of the formulas:

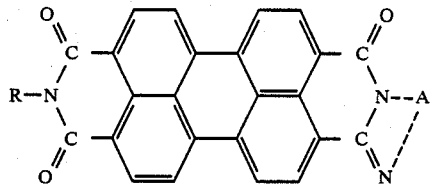

(I)

where

R denotes hydrogen, alkyl, hydroxyalkyl, alkoxyalkyl, aryl or aralkyl and

A denotes a radical selected from a phenylene, a napthylene and a more highly fused aromatic carbocyclic or heterocyclic radical, said radical being unsubstituted or substituted by a halogen, an alkyl group, a cyano group or an itro group;

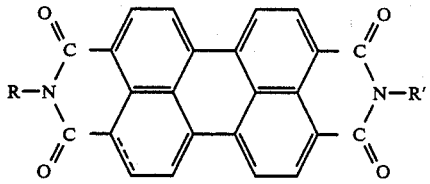

(II)

where

R and R' are different from each other and denote hydrogen or a group selected from alkyl, hydroxyalkyl, alkoxyalkyl, cycloalkyl, aryl, aralkyl and heteroaryl, said group being unsubstituted or substituted by a halogen, alkyl group, cyano group or nitro groups;

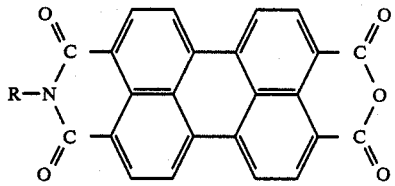

(III)

where

R denotes hydrogen or a group selected from alkyl, hydroxyalkyl, alkoxyalkyl, aryl and aralkyl, said group being unsubstituted or substituted by a halogen, an alkyl group, a cyano group or a nitro group.

10. The recording material as claimed in claim 9, wherein said perylene-3,4,9,10-tetracarboxylic acid imide is represented by formula (I)

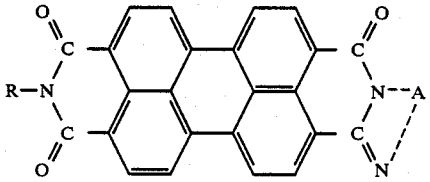

(I)

11. The recording material as claimed in claim 10, wherein R in formula (I) denotes lower alkyl or benzyl, and A denotes unsubstituted phenylene.

12. The recording material as claimed in claim 9, wherein said perylene-3,4,9,10-tetracarboxylic acid imide is represented by formula (II)

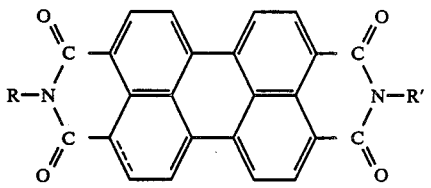

(II)

13. The recording material as claimed in claim 12, wherein, for formula (II), R denotes hydrogen, lower alkyl or benzyl and R′ denotes lower alkoxyalkyl, lower alkylsubstituted phenyl, benzyl or pyrenyl.

14. The recording material as claimed in claim 9, wherein said perylene-3,4,9,10-tetracarboxylic acid imide is represented by formula (III)

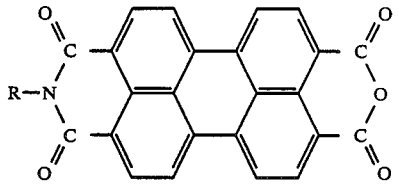

(III)

15. The recording material as claimed in claim 14, wherein R in formula (III) denotes lower alkyl, hydroxy lower alkyl, lower alkoxyalkyl, benzyl or phenylethyl.

16. The recording material as claimed in claim 9, wherein said binder is soluble in an aqueous alkali solution.

* * * * *